US006328024B1

(12) United States Patent
Kibort

(10) Patent No.: US 6,328,024 B1
(45) Date of Patent: Dec. 11, 2001

(54) AXIAL FLOW ELECTRIC SUPERCHARGER

(76) Inventor: Mark S. Kibort, 20511 Canyon View Dr., Saratoga, CA (US) 95070

( * ) Notice: Subject to any disclaimer, the term of this patent is extended or adjusted under 35 U.S.C. 154(b) by 0 days.

(21) Appl. No.: 09/535,260

(22) Filed: Mar. 23, 2000

Related U.S. Application Data

(60) Provisional application No. 60/126,905, filed on Mar. 30, 1999.

(51) Int. Cl.[7] ..... F02B 33/00
(52) U.S. Cl. ..... 123/565; 123/559.1
(58) Field of Search ..... 123/559.1, 565, 123/568.21; 417/423.1, 423.7

(56) References Cited

U.S. PATENT DOCUMENTS 4,485,310 * 11/1984 Valroger ..... 123/565 X
5,638,796 6/1997 Adams, III et al. .
6,135,098 * 10/2000 Allen et al. ..... 123/565

* cited by examiner

*Primary Examiner*—Hoang Nguyen
(74) *Attorney, Agent, or Firm*—Stanley Z Cole

(57) ABSTRACT

A supercharger employing an axial flow electric compressor or fan is described with its various connections to an internal combustion engine to obtain more power from the engine. A control system is also described to operate the supercharger from the throttle mechanism to obtain extra power with the use of the supercharger when the engine is otherwise performing at its normal (unaided) full power.

16 Claims, 5 Drawing Sheets

AXIAL FLOW ELECTRIC SUPERCHARGER

CROSS REFERENCE TO RELATED APPLICATION

This application claims the benefit of provisional application Serial No. 60/126,905, filed on Mar. 30, 1999.

FIELD OF THE INVENTION

This invention relates to an apparatus for increasing the power output of internal combustion engines.

BACKGROUND OF THE INVENTION

Superchargers are devices for increasing the power output of internal combustion engines. They achieve this by increasing the mass of air, which is input to the cylinders, thereby increasing the combustible mass of the air fuel mixture in each cylinder above that which would be pumped by the pistons at atmospheric pressure.

Superchargers of several types are known in the industry. One type is belt driven by the engine itself and is functional whenever the engine is operating. Such superchargers are large and relatively expensive, complex and add significant weight as some use precision gearing to multiply the speed of the engine rpms to achieve speed necessary to move the amount and pressure of air. Their size limits their ability to be used in the cramped engine compartments of modern automobiles. Their complexity usually requires professional installation as well as modifications to the engine management system. A second type is a turbo supercharger. This type uses the waste exhaust gas from the engine to drive a centrifugal impeller, which compresses the air input to the engine which is on a common shaft with the compressor. A third type of supercharger is electrically driven, does not use the engine itself as its power source directly, but instead uses a separate electric motor which is powered by a battery or other DC power source.

However, electric superchargers still suffer the disadvantages of size, complexity, weight and cost. They also operate whenever the engine is running, even when such operation would not be needed and may actually be undesirable. This could result in unnecessary wear and power loss of the entire system consisting of the engine, supercharger and power source for the supercharger. One other disadvantage of known electric superchargers which use centrifugal impellers is that the impeller must be operated at very high speed, of the order of 50–80,000 revolutions per minute, and therefore requires high current input, even when the engine is operating at low power.

A requirement therefore exists for a supercharger which is relatively small, simple, inexpensive, easy to install and operates only when maximum power is required from the engine. Such occasions could be during passing another car, during emergency maneuvers, or for limited periods during automobile race events. A supercharger which meets these characteristics would have significant use because of its cost and simplicity even if it provided only a modest increase in power, since even a modest increase would be important at critical times, especially in an automotive application.

SUMMARY OF THE INVENTION

According to a first aspect of the invention, an axial flow electric supercharger includes an axial flow fan/compressor, powered by a direct drive electric DC motor (brush or brushless style of commutation). The word fan will be used throughout. However, it should be understood that this apparatus may alternatively be described as a compressor.

An axial flow fan is used for several reasons:

A. It spools to a speed of about 20,000 to 21,000 rpm in less than 0.1 seconds to provide exceptionally quick response due to its light weight construction resulting in low inertia.

B. It does not need to operate continuously, and when not in operation, does not provide any significant restriction on the operators ability to achieve any power setting less than full output.

C. Such fans are relatively small simple and lightweight.

D. They are efficient for the desired mode of operation (i.e. providing large volumes of air at relatively low pressure increases).

E. Because they operate to provide relatively low pressure increases, they can be added without complex plumbing to most existing engines with no change to pre installed air fuel management systems.

F. They can be added to engines which already have traditional turbo or supercharger systems as a way to increase power output without increasing the pressure differential generated by those systems. (Total pressure available to an internal combustion engine equals the ambient pressure plus the pressure generated by mechanical forced air induction systems. The axial flow supercharger increases the ambient pressure of the air flowing into the turbo or supercharger, thus adding to the total air pressure available to the engine)

G. Installation is simple. All that is required to connect an axial flow supercharger are wires, switches, and adapter mounting tubes.

According to a second aspect of the invention, an electric supercharger includes a control system which can be set to operate only when additional engine output is needed or required. It is neither necessary nor desirable to operate a supercharger when less than full output of the engine is desired. When operating at partial output and more power is desired, it can be obtained by increasing throttle setting without actuating the supercharger. This minimizes wear of the electric supercharger and load on the battery or other source of electric power which drives the supercharger's motor. Therefore, a control system has been devised which operates only when maximum power is desired. In one embodiment, it consists of a micro-switch that is mounted to the accelerator pedal in a car, or to the throttle control directly in other embodiments, such that it activates and allows current flow to the motor of the supercharger only when the pedal or throttle are in their maximum positions.

In a preferred embodiment, the assembly is coupled directly to the engine's air input box, without removal of the existing input air filter.

In an other embodiment discussed hereinafter, the electric supercharger assembly is connected to the engine's air input box with the air box filter removed or alternatively replacing the air box and using a separate air filter on the electric supercharger.

In another embodiment, the supercharger is connected at any other location between the engine's air intake system and the atmosphere.

BRIEF DESCRIPTION OF THE DRAWINGS

For a better understanding of the present invention, reference is had to the accompanying drawings, which are incorporated herein by reference and in which.

DETAILED DESCRIPTION

Figure 1:
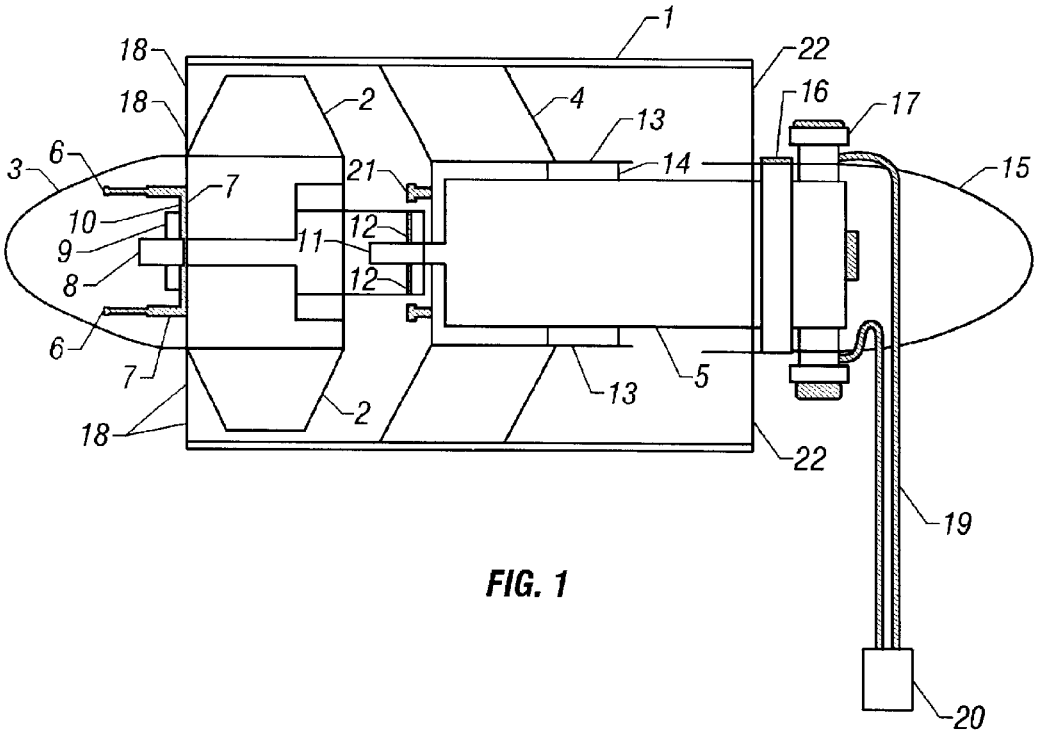
FIG. 1 is a schematic view of an electric supercharger in accordance with this invention.

An example of an implementation of an electric supercharger incorporating the inventive features described above is shown in FIG. 1. (Like numerals in different figures are intended to identify the same element or elements.) An electric supercharger system, shown in FIG. 1, comprises an axial flow tube housing 1, and axial flow impeller 2, a spinner 3, air flow straightening stators 4, and electric DC motor 5, and rear flow smoothing tail cone 15. Each component except the motor 5, should be made of acrylic, nylon plastic, or other temp resistant and structurally strong materials. The spinner 3, used to smooth inlet air flow, is attached to the axial impeller 2, by, for example, three screws 6, on the spinner mounting plate 7. The spinner mounting plate is attached to the axial impeller 2, by the main aluminum drive shaft 8, and, for example, a nut 9 and washer 10 arrangement, which attach the impeller 2 to the drive shaft 8. The main impeller drive shaft 8, attaches to the electric motor shaft 11, via two setscrews 12 or equivalent mechanism known to those skilled in the art. The electric motor is affixed to the motor attachment and alignment housing 13, by screws 21 or equivalent connectors, into the motor's front surface. The motor is aligned using, for example, a nylon spacer tube 14, that press fits the motor 5, into the motor attachment and alignment housing 13. The rear tail cone 15, is attached via an attachment strap 16, with cutouts to allow the motor's brush housings 17, to protrude and be unobstructed.

Air flow 18, enters the axial flow supercharger and is compressed by the rotating impeller blades 2 to a differential pressure above atmosphere. At about 20,000 to 21,000 rpm, the differential pressure created is approximately ½ PSI at a flow rate of about 500 CFM. The air passes the stators 4, reducing the swirl of the air flow, producing more mass flow. Air exits the electric supercharger at the rear of the said device 22, passing over the rear tail cone 15, which creates a laminar flow over the motor 5, and motor housing 13. This smoothing of the exit flow increases mass flow efficiency, as does the spinner 4, for the air 18, entering the electric supercharger. Power is applied to the electric supercharger by a voltage potential across the terminal wires 19, and connects to the power source with an electrical pin socket connector 20.

Figure 2:
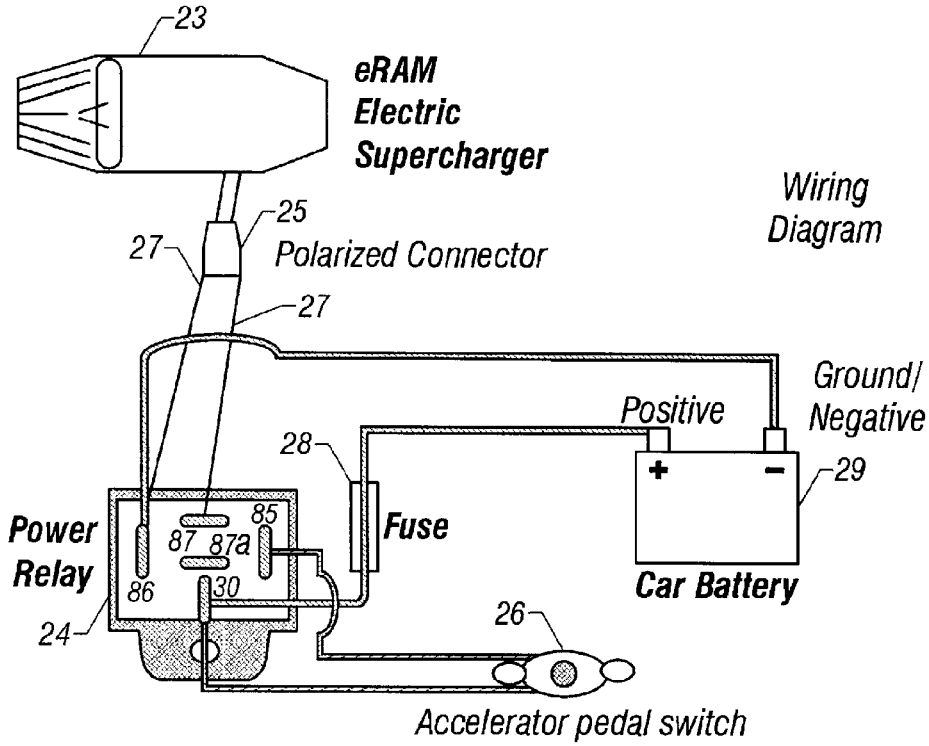
FIG. 2 is a schematic illustration of the control system for a supercharger in accordance with this invention.

In FIG. 2, operation of the control system is illustrated. The axial flow electric supercharger 23 connects to the power relay 24 via a pin socket connector 25. The power relay is activated by the full throttle operated micro switch 26. The micro switch 26, when engaged, uses battery power to route the voltage potential across the positive and negative motor wires 27, thus driving the motor with the battery potential. (Nominal 12 volts DC found in many automobile applications may be used.) The power circuit protective safety fuse 28, is in series with the wire leading to the power source 29.

Figure 3:
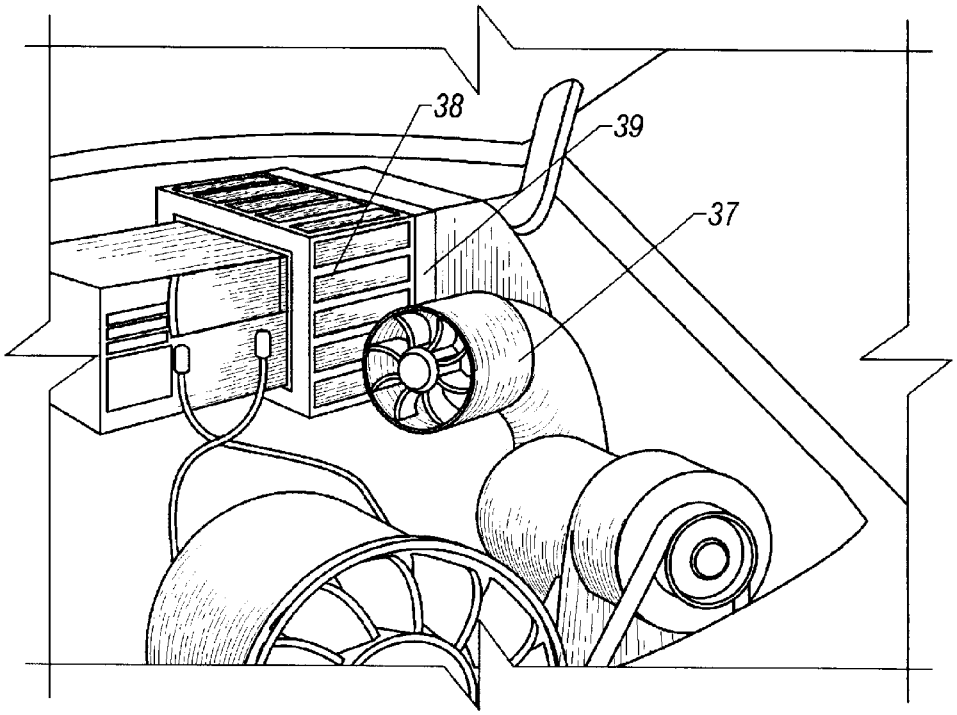
FIG. 3 is a schematic illustration of the preferred embodiment in which the supercharger assembly is coupled directly to the input of the engine's original air filter box.

In FIG. 3 there is shown a preferred embodiment in which an axial flow fan, which rotates at approximately 20,000 to 21,000 rpm, is used which is powered by a dc brush or brushless motor which draws approximately 40 amperes from a nominal 12 volt source. The assembly is coupled directly to the engine's air input box, without removal of the existing input air filter assembly 37 coupled to the engine's air input box 38, without removal of the existing input air filter 39.

Figure 4:
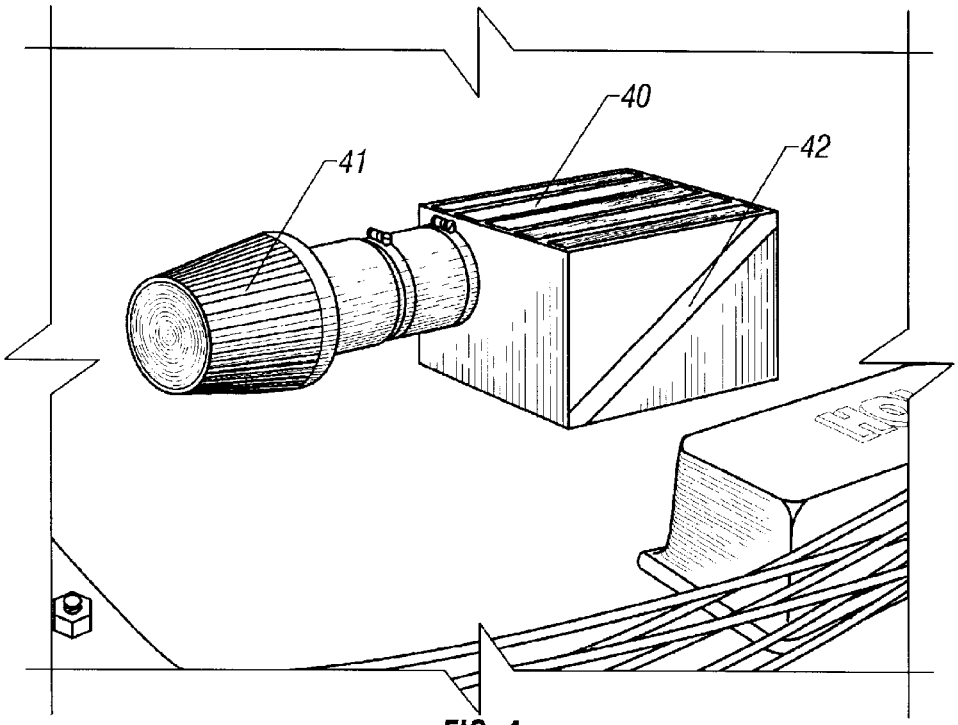
FIG. 4 is a schematic illustration of the electric supercharger attached directly to the input of the engine's air box in which the air filter contained within the air box has been removed and the electric supercharger's own integral cone air filter is used instead.

In FIG. 4, there is illustrated another embodiment in which the supercharger assembly is connected to the engine's air input box 40 which has had its air filter removed. The electric supercharger then is equipped with its own integral filter 41. The filter support structure may be retained to provide a good seal between the two halves of the air box 42.

Figure 5:
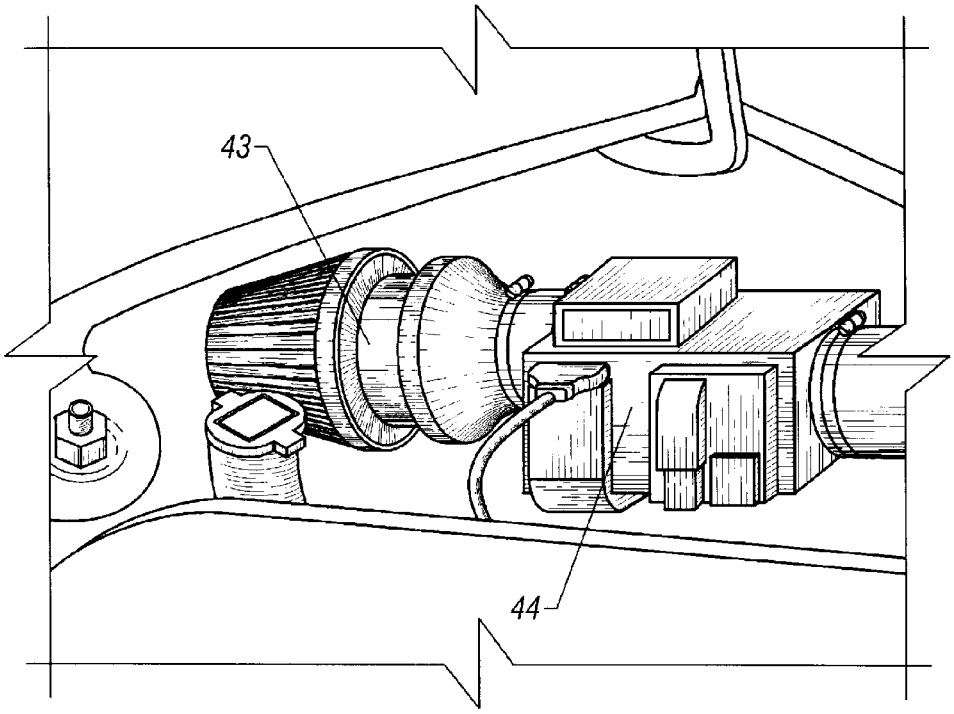
FIG. 5 is yet another schematic in which the electric supercharger is mounted directly on the air flow metering device replacing in its entirety, the original air box, and utilizing the electric supercharger's own integral cone air filter.
Figure 6:
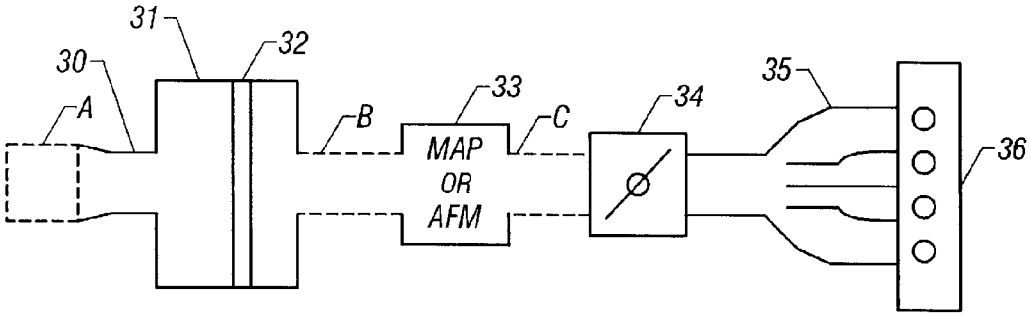
FIG. 6 is a schematic showing the air intake tract and other installation locations for the electric supercharger.

In yet another embodiment, illustrated in FIG. 5, the supercharger is connected at any location between the engine's air intake system and atmosphere, where the electric supercharger 43 is attached directly to the air flow meter 44, or as shown in FIG. 6 at any position A, B or C.

In FIG. 6, there is shown a typical automobile internal combustion engine with an air intake system. The components are: the air inlet 30, air filter box 31, air filter 32, air flow meter 33, throttle body 34, intake manifold 35 and engine 36. The axial flow electronic supercharger can be placed along the air flow path at locations A, B or C.

Test results

Figure 7:
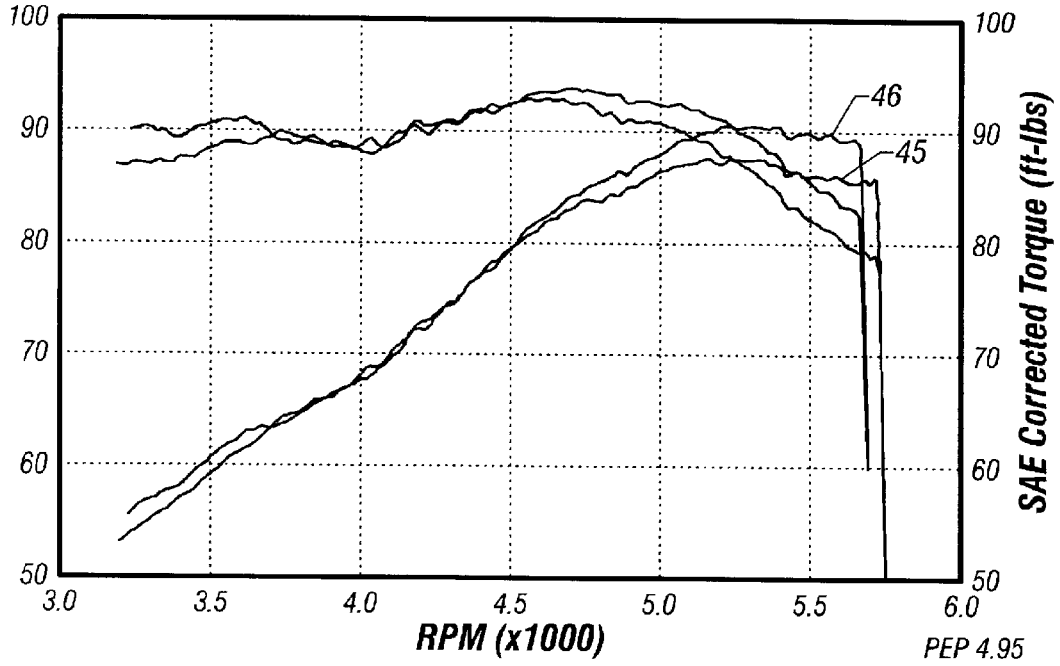
FIGS. 7–10 are graphic illustrations of the improvements achieved using the present invention in various engine arrangements.

Case 1: The device described above was placed in a 1997 4 cylinder Honda Civic. Using a DynoJet 248e chassis dynamometer, a baseline HP was established to be 88 hp (45). After installation of the supercharger of this invention, the HP output was raised by 5% to 92 hp (46) (a 4HP improvement over 88HP baseline). This is illustrated in FIG. 7.

Case 2: The supercharger of this invention was then installed on a 6 cylinder 1984 Porsche 911 Carrara. Using the same conditions of the prior test, the vehicle was found to make a 5% HP improvement reaching 210 hp (47) over its baseline HP of 201 (48).

Figure 8:
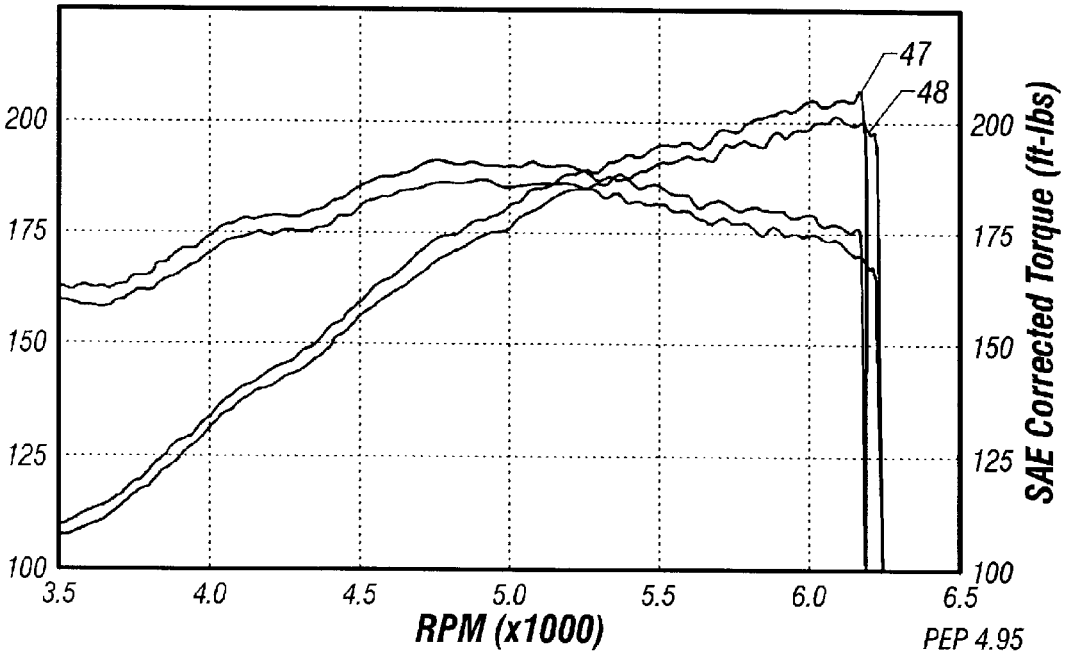

This is illustrated in FIG. 8.

Figure 9:
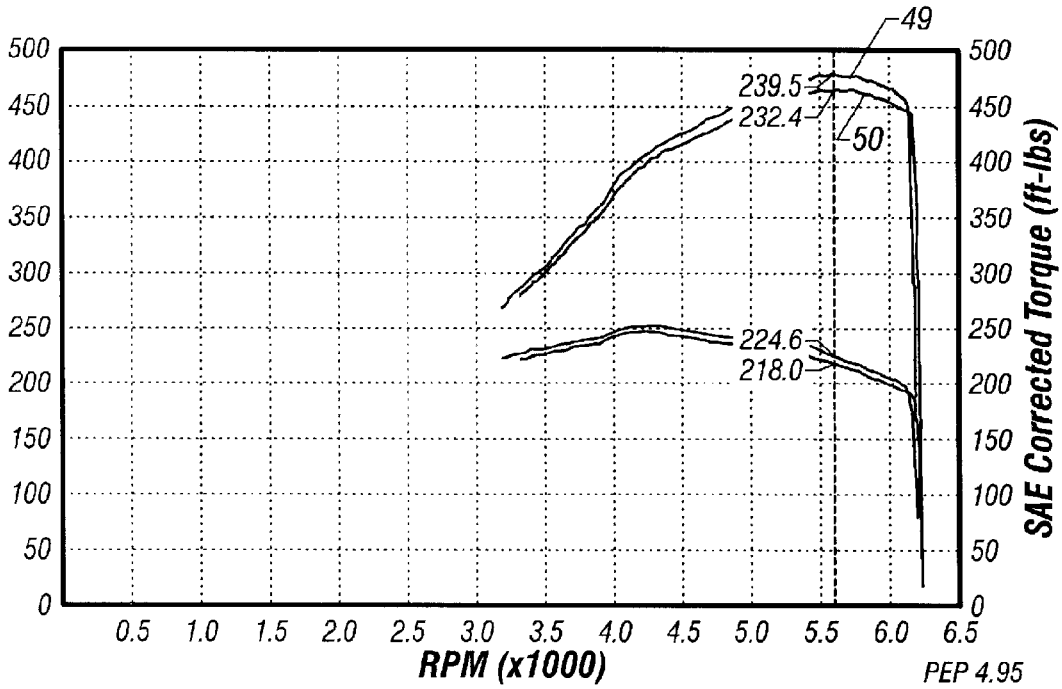

Case 3: The supercharger device was installed in a 1984 V8 Porsche 928S, using the same conditions above. It was found to provide a 3–4% improvement in HP reaching 240 hp (49) over its baseline run of 232 hp (50). This is illustrated in FIG. 9

Figure 10:
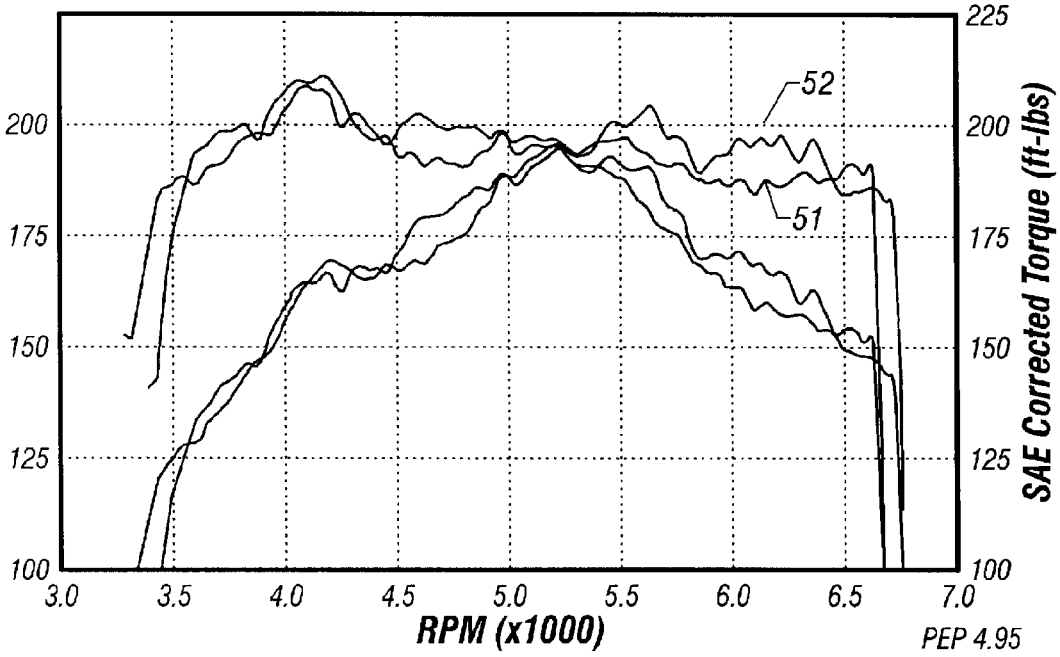

Case 4: The device was installed in a vehicle which already had a turbocharger. A 1993 Toyota four cylinder MR2 turbo with a modified boost pressure of 17 psi was tested. After the installation of the said device, a 5% over baseline HP of 198 (51), was achieved at the same boost levels reaching an improved HP of 208 (52). In this respect, see FIG. 10.

While there have been shown and described what are at present considered the preferred embodiments of the present invention, it will be obvious to those skilled in the art, that various changes and modifications may be made therein without departing from the scope of the invention as defined by the appended claims.

What is claimed is:

1. An axial flow electric supercharger for an internal combustion engine comprising a tubular housing of uniform diameter to surround the components of said supercharger, an axial flow electric fan including a rotatable impeller mounted in said housing at an end thereof to compress and axially flow air into said housing, air flow straightening stators positioned within said housing in the path of axially flowing air following said impeller, said stators converting said air flow in said housing into laminar flow, said supercharger adapted to be mounted and positioned inrespect to the internal combustion engine to feed its output into the engine, a vinary control system to energize said fan to provide larger volumes of air exiting from said supercharger during those periods that the fan is energized, said output air fed into the engine during periods when said fan is energized causing the engine's power output to increase.

2. A supercharger as set forth in claim 1 adapted to be mounted and positioned in respect to the internal combustion engine.

3. A supercharger in accordance with claim 2 in which the output is fed to an air filter at the input air intake system of the engine to filter air fed into the engine while the output of said fan is being fed to the engine.

4. A supercharger in accordance with claim 2 including an integral air filter at the output of said supercharger.

5. A supercharger as set forth in claim 4 in which said air filter comprises an integral cone air filter.

6. Apparatus to increase the power output of an internal combustion gas engine comprising an internal combustion engine having an air filter at an input end, an axial flow electric fan mounted with a substantially uniform diameter housing of an electric supercharger connection to said internal combustion engine, said fan including a rotatable impeller to compress and axially flow air into said housing while said fan is energized, and a binary control system for said fan to cause said fan to only operate when maximum engine output is desired including a switch to energize said fan when the gas applicator of the engine is in its maximum position, said housing for said axial flow fan being coupled at its output end directly to the input box of said engine whereby increased air flow is fed into said engine while said fan is energized.

7. Apparatus in accordance with claim 6 in which the air filter at the input end of said engine is in position at said engine while the output of said fan is fed directly to said engine through said air filter.

8. Apparatus in accordance with claim 6 including an integral cone filter mounted at the output of said fan and in which the air filter of the input box of said engine is removed from said engine and air is fed directly into the input box from the integral cone air filter at the output of said fan.

9. Apparatus as set forth in claim 5 in which said fan is mounted to replace the air filter input box of said engine and air is fed directly into said engine from the integral cone air filter of said fan.

10. A supercharger as set forth in claim 1 in which the output of said axial flow fan is configured to be fed to the engine at a point prior to the air intake manifold of the engine intake system.

11. A method of increasing the power output of an internal combustion engine comprising positioning an axial flow fan comprising a rotatable impeller causing axial flow of air to enter into an electric supercharger housing of substantially uniform diameter surrounding said impeller within said housing, flowing compressed air out of said housing, feeding the output of the fan into the intake system of the engine, and energizing the fan with a binary switch activated by the application of full throttle to said engine when additional power is desired from the engine.

12. The method of claim 11 including flowing the flow output of the axial flow fan directly into the air Input box of the engine.

13. The method of claim 12 including removing the air box from the engine and flowing the flow output of the axial flow fan through a filter directly into the air input box of the engine.

14. The method of claim 12 including removing the air filter of the input box of the engine and feeding the fan output through said integral filter of said fan directly into the air input box of the engine.

15. The method of claim 11 including feeding the output of the fan into the engine at a position prior to the throttle body of the engine.

16. The method of claim 12 including flowing the output air into a filter of the air input box.

* * * * *

UNITED STATES PATENT AND TRADEMARK OFFICE

CERTIFICATE OF CORRECTION

PATENT NO. : 6,328,024 B1
DATED : December 11, 2001
INVENTOR(S) : Mark S. Kibort It is certified that error appears in the above-identified patent and that said Letters Patent is hereby corrected as shown below:

Column 5,
Line 13, change "vinary" to -- binary --.
Line 26, change "output" to -- input --.

Column 6,
Line 4, change "output" to -- input --.
Line 7, delete "the integral cone air filter at".
Line 10 and 11, delete "the integral cone air filter of".
Line 37, delete "through said integral filter of said fan".

Signed and Sealed this

Twenty-third Day of April, 2002

*Attest:*

*Attesting Officer*

JAMES E. ROGAN
*Director of the United States Patent and Trademark Office*